US007298348B2

(12) United States Patent
Salters et al.

(10) Patent No.: US 7,298,348 B2
(45) **Date of Patent: *Nov. 20, 2007**

(54) PLASMA DISPLAY PANEL ELECTRODE AND PHOSPHOR STRUCTURE

(75) Inventors: Bart Andre Salters, Eindhoven (NL); Siebe Tjerk De Zwart, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 393 days.

This patent is subject to a terminal disclaimer.

(21) Appl. No.: 10/507,677

(22) PCT Filed: Mar. 17, 2003

(86) PCT No.: PCT/IB03/00954

§ 371 (c)(1),
(2), (4) Date: Sep. 14, 2004

(87) PCT Pub. No.: WO03/079392

PCT Pub. Date: Sep. 25, 2003

(65) Prior Publication Data

US 2005/0151704 A1 Jul. 14, 2005

(30) Foreign Application Priority Data

Mar. 19, 2002 (EP) ..... 02076143

(51) Int. Cl.
*G09G 3/28* (2006.01)

(52) U.S. Cl. ..... 345/60; 315/169.4

(58) Field of Classification Search ..... 345/55, 345/60, 66–68; 315/169.1, 169.3–169.4
See application file for complete search history.

(56) References Cited

U.S. PATENT DOCUMENTS

| | | | | |
|---|---|---|---|---|
| 5,311,205 | A | 5/1994 | Hamada et al. | 345/88 |
| 5,825,128 | A | 10/1998 | Betsui et al. | 313/582 |
| 2001/0040539 | A1 | 11/2001 | Hashimoto | 345/60 |
| 2002/0109457 | A1* | 8/2002 | Duineveld et al. | 313/504 |

FOREIGN PATENT DOCUMENTS

EP 0762373 3/1997

* cited by examiner

*Primary Examiner*—Amr A. Awad
*Assistant Examiner*—Michael Pervan

(57) ABSTRACT

The invention relates to an AC plasma display panel (12) of the surface discharge type, and more specifically to the structure of the address electrodes (5) of the panel and of the phosphor elements, and to a plasma display panel device comprising such a panel. According to the invention, only one address electrode (5) is used for one out of every two columns. Scan electrodes (8) and common electrodes (7) may comprise transparent parts (11). These parts (11) may extend over one out every two cells in a checkerboard fashion. In a preferred embodiment, the columns may have alternating wide (15) and narrow (16) cells (2). Furthermore, each cell has a neighbor-cell of the same color on the same address electrode but in a neighboring column and in a neighboring row. The display panel device comprises a driving circuit (22) arranged such that in at least one of the sub-fields the neighboring cells are addressed simultaneously.

16 Claims, 15 Drawing Sheets

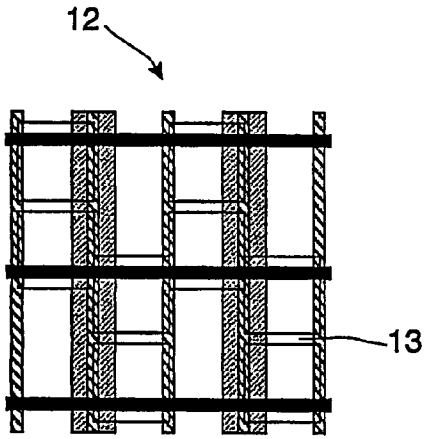
FIG.6a
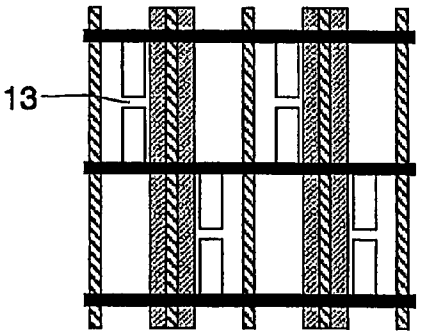
FIG.6b
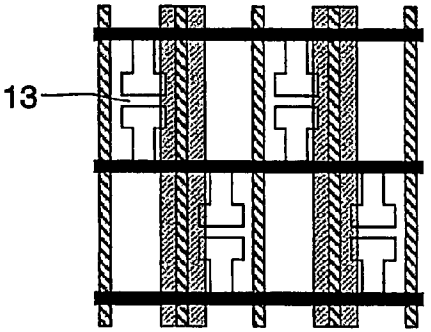
FIG.6c
FIG.6d
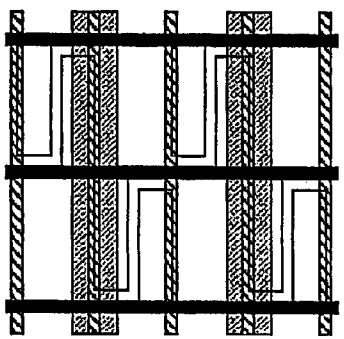
FIG.6e
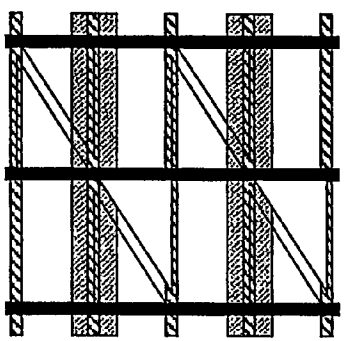
FIG.6f
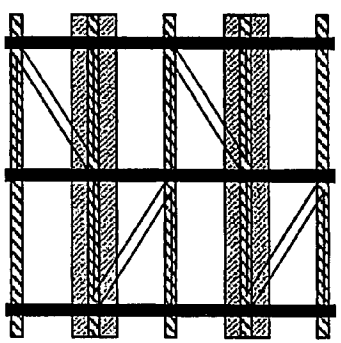
FIG.6g

PLASMA DISPLAY PANEL ELECTRODE AND PHOSPHOR STRUCTURE

FIELD OF THE INVENTION

The invention relates to a plasma display panel comprising a first substrate having, formed thereon, a set of common electrodes extending in a first direction, and, alternately with said common electrodes, a set of scan electrodes extending in the same direction, the space delimited between a common electrode and a scan electrode defining a row, and a second substrate parallel to said first substrate, having, formed thereon, a set of address electrodes and a set of barrier ribs, both extending substantially perpendicularly to said first direction, the space delimited by a pair of adjacent barrier ribs defining a column, the space at the intersection of a row and a column defining a cell, and more specifically to the electrode structure and phosphor structure thereof.

The invention relates to an AC plasma display panel of the surface discharge type.

The invention also relates to a plasma panel display device comprising a plasma display panel and a driving circuit.

BACKGROUND OF THE INVENTION

Plasma display panels and methods of driving such panels are known in the art. Plasma display panels are matrix devices comprising individual cells defined by the intersection of rows and columns. The structure of a panel 1 as known from EP 0 762 373 is shown schematically in FIG. 1 in a front view. FIGS. 2*a* and 2*b* are a detailed perspective view and a side view, respectively, of a single cell 2. The panel comprises a front plate 3, made of a transparent material, and a back plate 4. A first set of parallel address electrodes 5 a1, a2, a3, . . . , an, an+1 . . . are located in a direction perpendicular to the first direction on the back plate. Barrier ribs 6, located parallel to the address electrodes 5, also on the back plate 4, perform the function of separating cells 2 from neighboring columns. A second set of electrodes comprises common electrodes 7 and scan electrodes 8. These electrodes are located on the front plate 3, facing the address electrodes 5 on the back plate 4. The common electrodes 7 are in this example divided into two groups, that is c1 and c2. The scan electrodes 8 s1, s2, s3 . . . are separately addressable. Said second set of electrodes is oriented in a first, in this figure the horizontal direction, which is substantially orthogonal to the address electrodes 5. Phosphors 9 deposited on the back plate 4 perform the function of converting ultraviolet light UV, produced by a gas discharge GD between a common electrode 7 and a scan electrode 8, into visible light VL. Light of the desired color, e.g. red, green, blue, is produced by selecting different types of phosphors 9.

Common electrodes and scan electrodes known in the art may be formed of a metallic part 10 and a transparent part 11. The metallic part 10 ensures the conduction of the current flowing through the electrode. Via the conductive transparent part 11 the voltages applied to the electrode are present across the desired areas of the cells 2. The transparent parts 11 may be made of a thin layer of metal oxides (ITO).

On display of successive picture frames on such a plasma display panel 1, a frame is divided into an odd field and a subsequent, even field. Odd rows, i.e. rows between electrodes c1 and s1, c2 and s2, c1 and s3 in FIG. 1, produce light during an odd field, and even rows, i.e. rows between electrodes s1 and c2, s2 and c1 in FIG. 1, produce light during an even field.

In known plasma display panels, each column requires one address electrode. A VGA display, comprising 640 columns, requires 1920 address electrodes (one for each color). Increasing the picture resolution by adding columns further increases the number of address electrodes and, therefore, the cost of the panel and the associated driving electronics.

SUMMARY OF THE INVENTION

It is an object of the invention to provide a plasma display panel with a reduced number of electrodes, thus reducing costs while enabling a good peak brightness, nevertheless.

It is a further object of the invention to provide a plasma display panel device having a plasma display panel with a reduced number of electrodes and which enables a good peak brightness.

The invention provides a plasma display panel as defined in claim 1. An address electrode extends over more than one column, covering at least a part of a cell in a first column in one row, and at least a part of a cell in another column in the row immediately below, no other address electrode extending over the cell immediately below the first cell, nor over the cell immediately above the second cell. The number of address electrodes is thereby reduced by half with respect to a plasma display panel of the known type. The number of column drivers is also reduced by a factor of two, so the total cost reduction is substantial. The plasma display panel appears as a checkerboard, where one cell out of every two cells is addressable. In addition in a plasma display panel in accordance with the invention each cell has a neighbor-cell of the same color, on the same address electrode but in an neighboring column and in a neighboring row. The term neighboring is used to indicate that a column or row does not have to be next to another column, respectively row, but that a few other columns, respectively rows may be positioned inbetween. The term adjacent is used to indicate that there are no other columns rows inbetween two adjacent columns, respectively two adjacent rows.

This allows the plasma display panel to be used in combination with a driving circuit for addressing the cells in sub-fields, which circuit is arranged such that in at least one of the sub-fields said neighboring cells are addressed simultaneously. Two cells (in different columns and in different rows) can now be addressed simultaneously, which reduces the address time and thereby increases the sustain time.

The plasma display panel device in accordance with the invention comprises a plasma display panel as defined in claim 1 and has a driving circuit which is arranged such that in at least one of the sub-fields said neighboring cells are addressed simultaneously.

For matrix display panel types as described above, the generation of light cannot be modulated in intensity so as to create different levels of gray scale, as is the case for CRT displays. On said matrix display panel types, gray levels are created by modulating in time: for higher intensities, the duration of the light emission period is increased. The luminance data are coded in a set of sub-fields, each having an appropriate duration or weight for displaying a range of light intensities between a zero and a maximum level. Different combinations of sub-fields result in different grey levels. Such a sub-field decomposition, described here for grey scales, will also apply hereinafter to the individual colors of a color display.

In order to reduce the time necessary for displaying a frame, a multiple row addressing method may be applied. In this method, more than one, usually two, neighboring and preferably adjacent rows are simultaneously addressed, thereby receiving and displaying the same data.

This so-called double-line addressing method (when two lines are simultaneously addressed) effectively allows for more time for light emission and/or speed-up of the addressing of a frame, because each frame requires less addressing actions.

In order to reduce loss of resolution, while still gaining time, line doubling can be done for only some sub-fields. The resulting Partial Line Doubling (PLD) will then give less loss in resolution.

Within the framework of the invention both line doubling as well as PLD are possible; preferably, however, PLD is performed, that is, preferably for a number of least-significant bits.

In a preferred embodiment the common electrodes and scan electrodes comprise a conductive, preferably metallic part and a set of transparent parts. These transparent parts are formed in such a way as to allow discharges in one out of every two cells of the panel, that is, in a checkerboard fashion.

The transparent parts may be made of areas of a thin layer of metal oxide (ITO). In a further preferred embodiment the common electrodes and scan electrodes have transparent parts made of areas of a thin metal grid. This has the advantage that the production of the conductive, preferably metallic part and the transparent parts of an electrode may be performed in a single process step.

Address electrodes formed as straight strips underneath one out of every two barrier ribs are especially easy to produce and are also robust. The layout of the transparent parts in a checkerboard fashion ensures that only the desired cells produce light.

Zigzag address electrodes may reach cells in adjacent columns in each successive row and still remain narrow. Narrow electrodes have the advantage of a reduced capacitance and, therefore, require less power. The period of the zigzag electrodes may encompass two or more rows. The address electrodes may even be formed in diagonals across the whole height of the panel. Zigzag electrodes have the additional advantage that they only cover cells where a discharge is desired, thereby reducing the risk of spurious discharges.

The transparent parts of common electrodes and scan electrodes may extend slightly over the cell immediately above, or below, in the same column. The discharge space is thereby extended further in the vertical direction. This increases the part of the surface of the panel that produces light, and thereby increases the brightness.

The transparent parts may extend over only part of the width of a cell. The capacity of the electrodes is thereby reduced, and the currents required to drive the panel are reduced accordingly. The transparent parts may have a wider portion near the gap. This improves the quality of a discharge occurring between said pair of transparent parts.

The two transparent parts may extend side by side, the gap between said two transparent parts extending vertically over said cell. The surface gas discharge between said two transparent parts occurs over an increased gap length and is thereby improved.

The address electrodes may comprise an extension extending substantially over the gap. This extension increases the coverage of the address electrodes to the desired cells. These extensions may be applied to straight address electrodes as well as to zigzag address electrodes.

In a preferred embodiment the barrier ribs have a shape forming enlarged cells used for producing light, i.e. forming active cells, and cells of reduced width remaining unlit, i.e. inactive cells. The ratio of light producing area to unlit area is thereby increased, and the brightness of the panel is significantly improved. Address electrodes in this embodiment may be of the straight type or of the zigzag type. The cells of reduced width may be reduced to nil area or nearly nil area.

The transparent parts of the common and scan electrodes may be formed as continuous strips. The production cost of the panel is thereby reduced. No precise alignment in the horizontal direction of the front plate with respect to the back plate is necessary.

By having columns at an angle different from 90° with respect to the first direction, a pattern of cells may be obtained, wherein all cells in a column are of a same color. This is easier to manufacture as in a column between two barrier ribs only one color of phosphor has to be applied.

The address electrode may have a zigzag shape, thereby extending in subsequent rows over cells of a same color. Such a configuration enables the application of a PLD scheme as two cells in neighboring rows, connected to a same electrode, are of a same color.

These and other aspects of the invention are apparent from and will be elucidated with reference to the embodiments described hereinafter.

BRIEF DESCRIPTION OF THE DRAWINGS

In the drawings:

FIGS. 6A to 6G are front views of plasma display panels according to the invention showing different embodiments of the transparent parts of the scan electrodes and the common electrodes;

The Figures are not drawn to scale. Generally speaking, identical components are denoted by the same reference numerals in the figures.

DETAILED DESCRIPTION OF PREFERRED EMBODIMENTS

Figure 1:
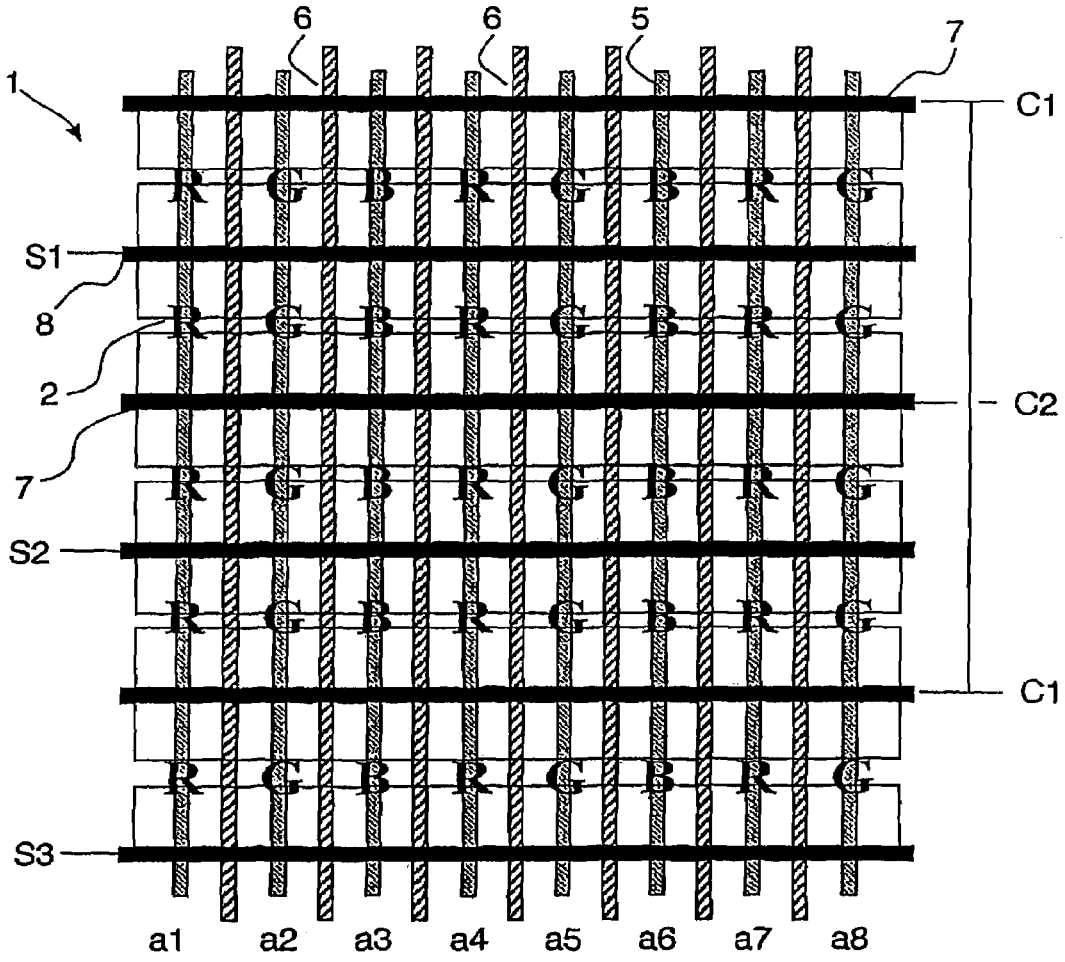
FIG.1 PRIOR ART
FIG. 1 is a front view of a plasma display panel known in the prior art.
Figure 2A:
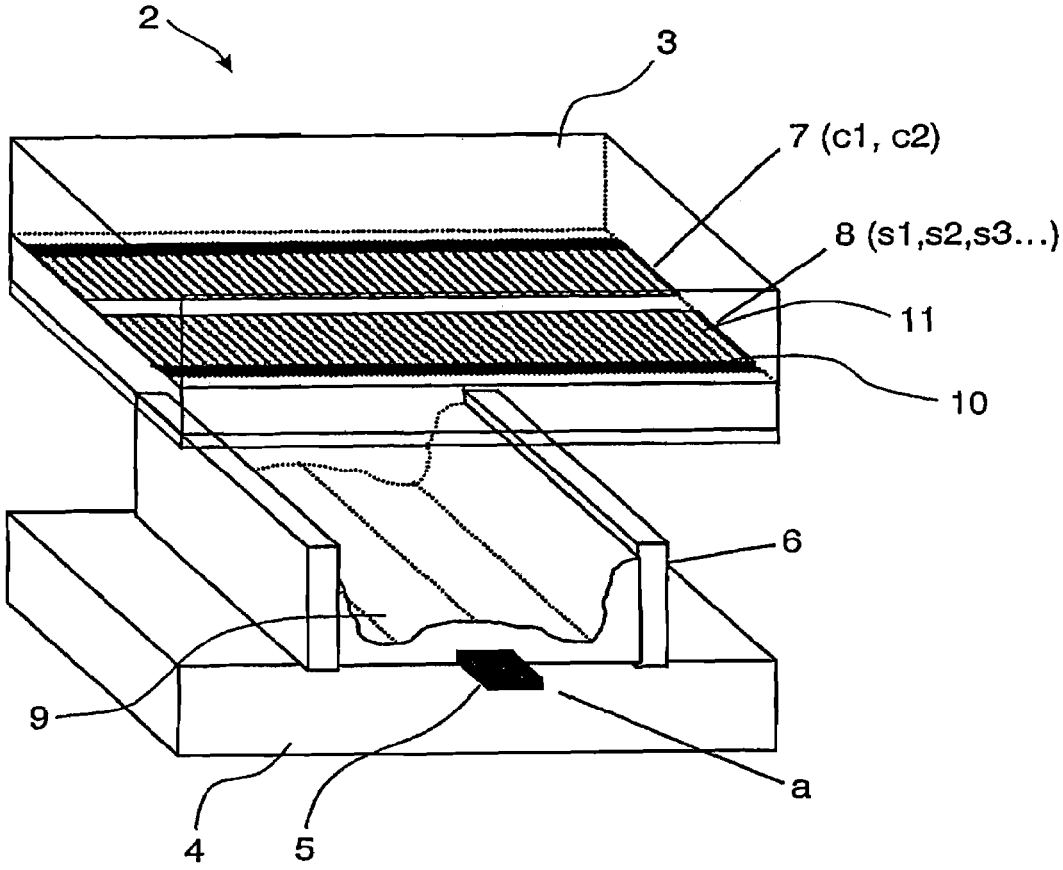
FIG.2A PRIOR ART
FIGS. 2A and 2B are a perspective view and a side view, respectively, of a single cell of a plasma display panel known in the prior art.
Figure 2B:
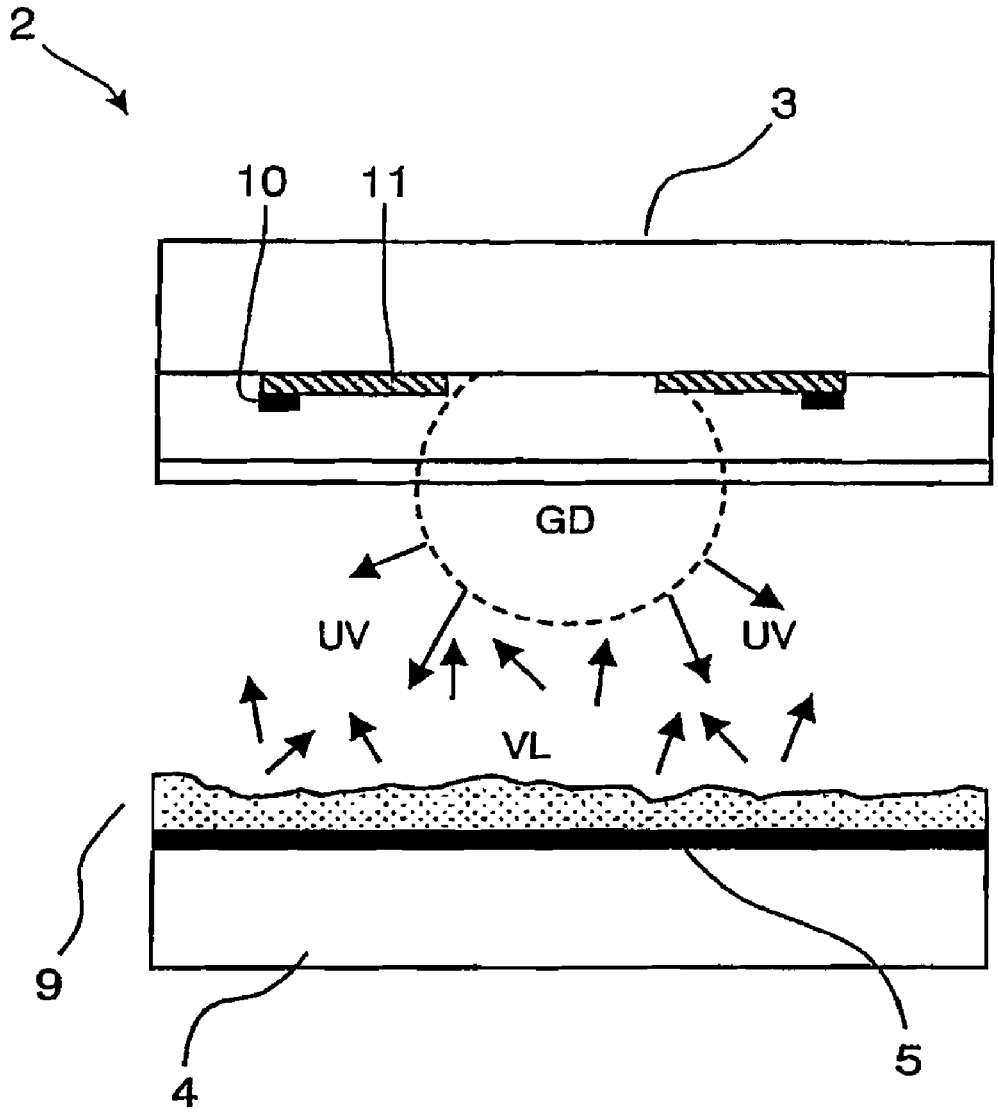
FIG.2B PRIOR ART

The FIGS. 1 and 2A, 2B have already been described.

Figure 3A:
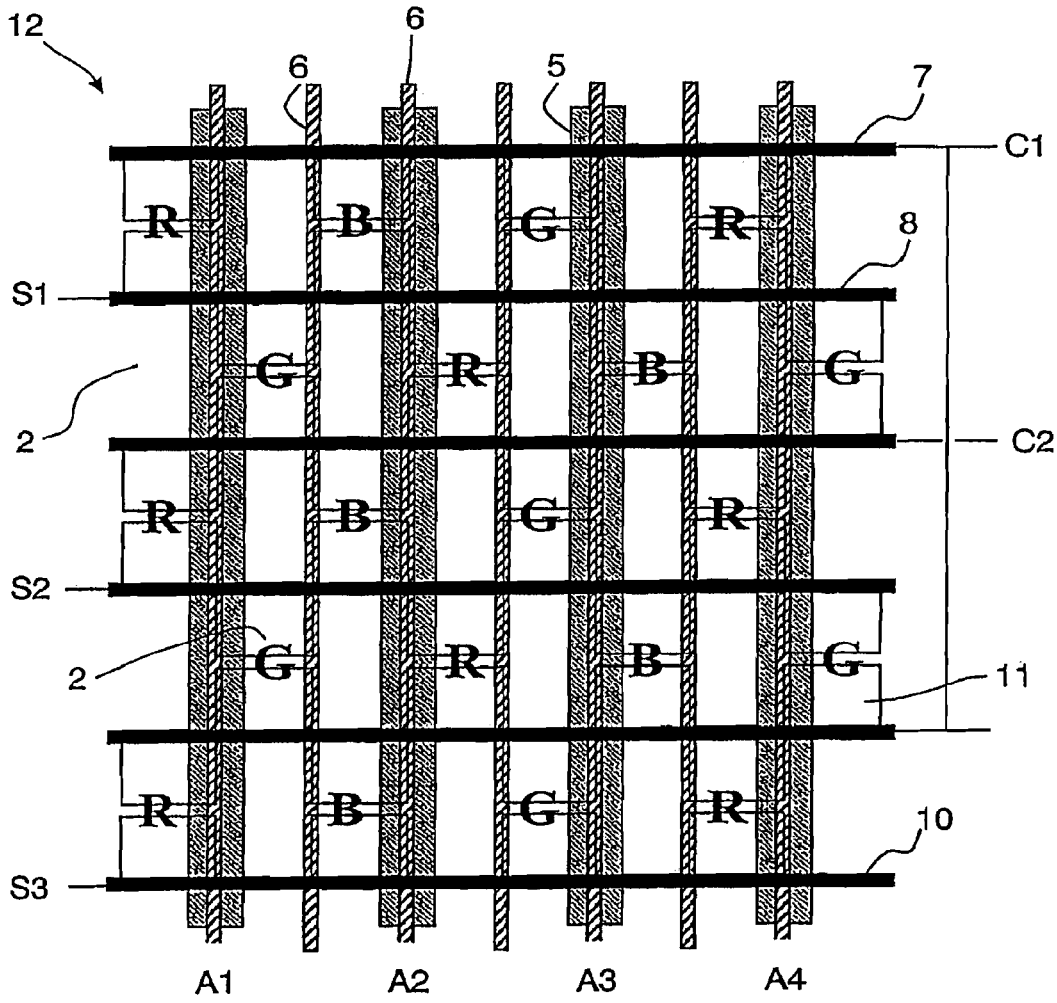
FIG.3A PRIOR ART
FIG. 3A is a front view of a plasma display panel having a standard phosphor pattern.
Figure 3B:
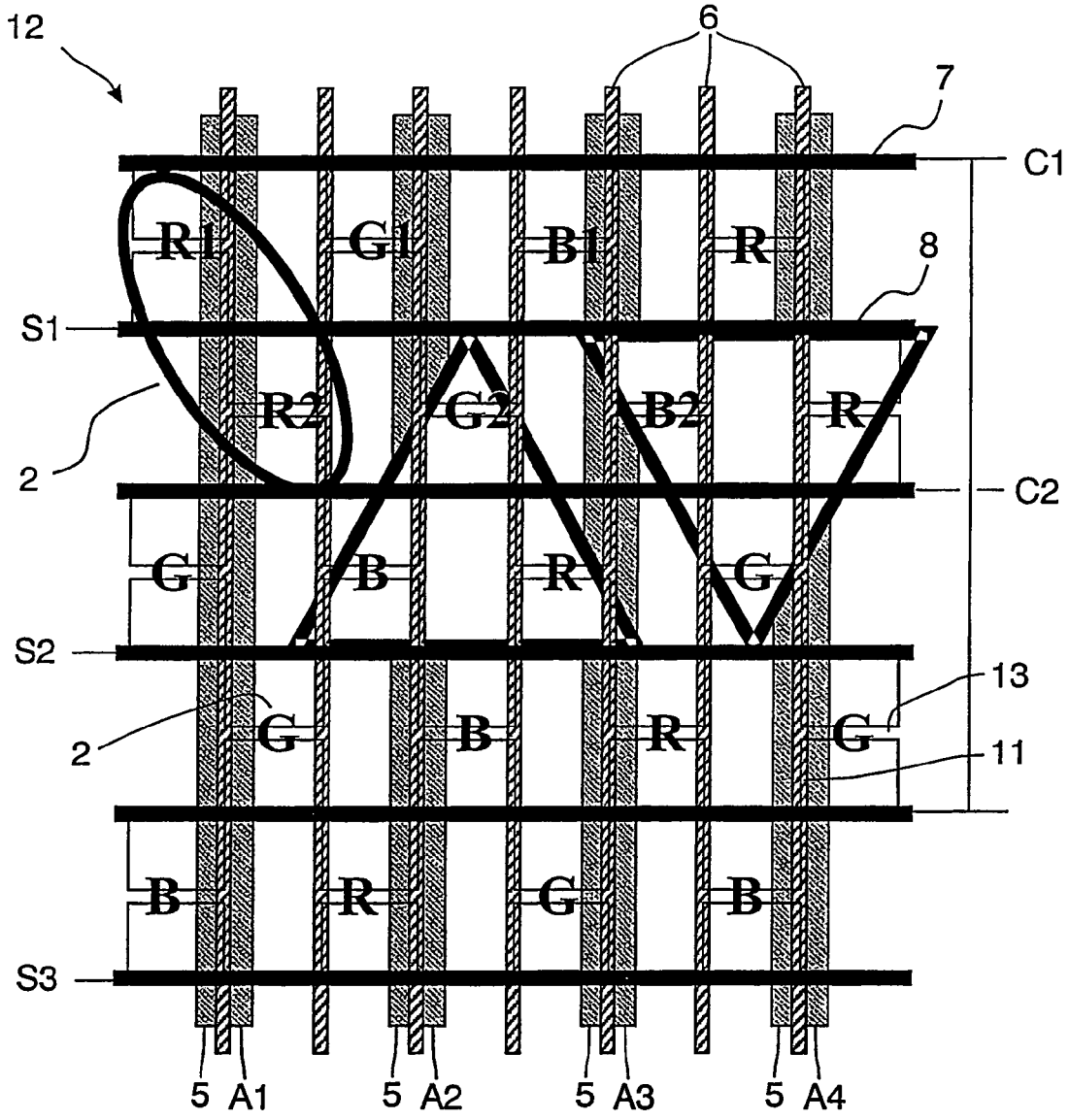
FIG. 3B is a front view of a plasma display panel according to the invention.

A plasma display panel 12 with a standard phosphor pattern is shown in FIG. 3A and a plasma display panel 12 according to the invention is shown in FIG. 3B. Common electrodes 7 C1, C2 and, alternating therewith, scan electrodes 8 S1,S2,S3 extend in a horizontal direction. Address electrodes 5 A1, A2, A3, A4 are formed as strips on the back plate for one out of every two columns. Barrier ribs 6 are formed on the back plate, one out of every two barrier ribs 6 being formed above an address electrode 5. The widths of the address electrodes 5 and of the barrier ribs 6 are such that an address electrode 5 A1 . . . A4 appears on both sides of the barrier rib 6. Common electrodes 7 and scan electrodes 8 comprise transparent parts 11 extending over one out of every two cells 2 in a checkerboard fashion. The voltage applied to an address electrode 5 during the addressing phase is thus applied to two neighboring cells of a row being scanned. The transparent parts of the common electrodes 7 and the scan electrodes 8 being scanned ensure that a write discharge occurs only in the cell being covered by transparent parts 11 and not in the neighboring cell. The address electrode 5 A1 of FIG. 3 may be considered as the fusion of the address electrodes 5 a1 and a2 of FIG. 1, and the address electrode 5 A2 as the fusion of a3, a4 etc. . . . The voltage to be applied to the electrode A1 is the one applied to a1 during the scanning of odd rows, and the one applied to a2 during the scanning of even rows.

Figure 4:
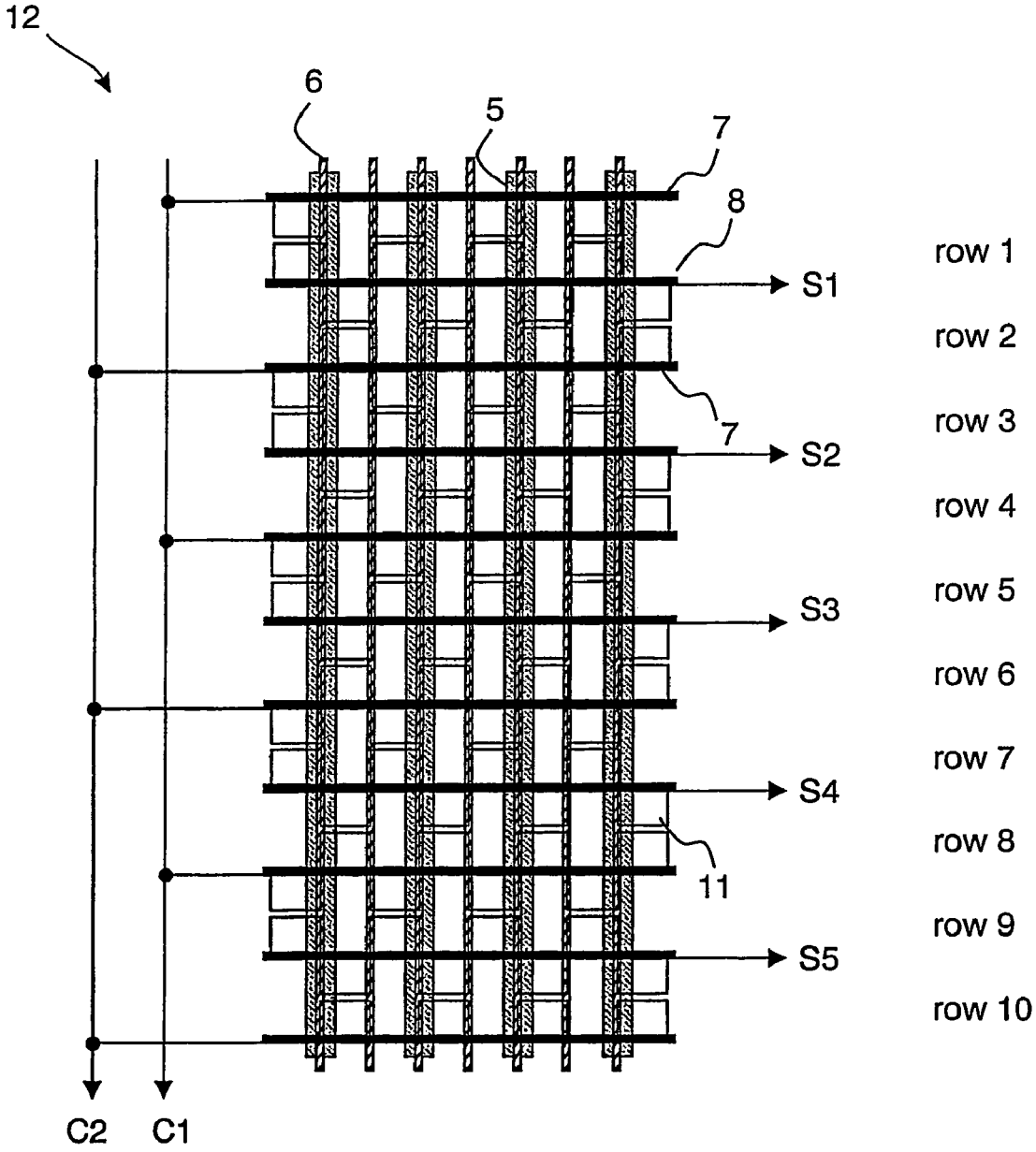
FIG. 4 is a front view of the same plasma display panel showing how common electrodes are grouped.

FIG. 4 shows how the odd common electrodes 7 C1 are connected to a single driver, and the even common electrodes 7 C2 are connected to another single driver. Each scan electrode 8 S1,S2,S3,S4,S5 is connected to a single driver.

This novel layout for Plasma Display Panels (PDPs) reduces the required number of address electrodes by a factor of two. The number of column drivers is also reduced by a factor of two, so the total cost reduction is substantial. This holds for both FIGS. 3A and 3B. However, when combining a standard phosphor pattern as shown in FIG. 3A with Partial Line Doubling (PLD), the image quality will not be optimal. As the pattern of cells with a different color, for example, red, green and blue as indicated by the respective letters R, G and B is considerably shifted between two adjacent rows, partially line doubling would result in image quality reduction when applied to two adjacent rows. In this case it would be more appropriate to apply PLD to, for example, two subsequent even rows or two subsequent odd rows. However, as the distance between two such rows is larger there will be some reduction of image quality, when applying PLD. If no PLD would be applied, then the resulting relatively large address time implies that less time is available for light output, thus leading to a lower peak brightness. In a plasma display panel in accordance with the invention, as is shown in FIG. 3B, each cell has a neighbor cell with the same color, on the same address electrode but in an adjacent column and in an adjacent row, whereas when standard phosphor pattern lay-outs are used, neighboring cells in adjacent rows have a different color. Using the standard phosphor pattern each cell has a neighboring cell of a different color, i.e. along a addressing electrode the sequence of cells is R-G-R-G-R and B-R-B-R-B and G-B-G-B-G. In a plasma display panel in accordance with the invention the phosphor elements along an addressing electrode are arranged as R-R-G-G-R-R etc. Thus, each cell has a neighbor cell of the same color on the same-address in an adjacent column and in an adjacent row (rows are also called lines). This allows a reduction of the time-required for addressing the cells by applying PLD or Bit Line Repeat (BLR). As example of pairs of cells to which PLD may be applied, several pairs R1,R2; G1,G2; and B1,B2 are indicated, an ellips being drawn around a pair R1, R2.

Figure 5:
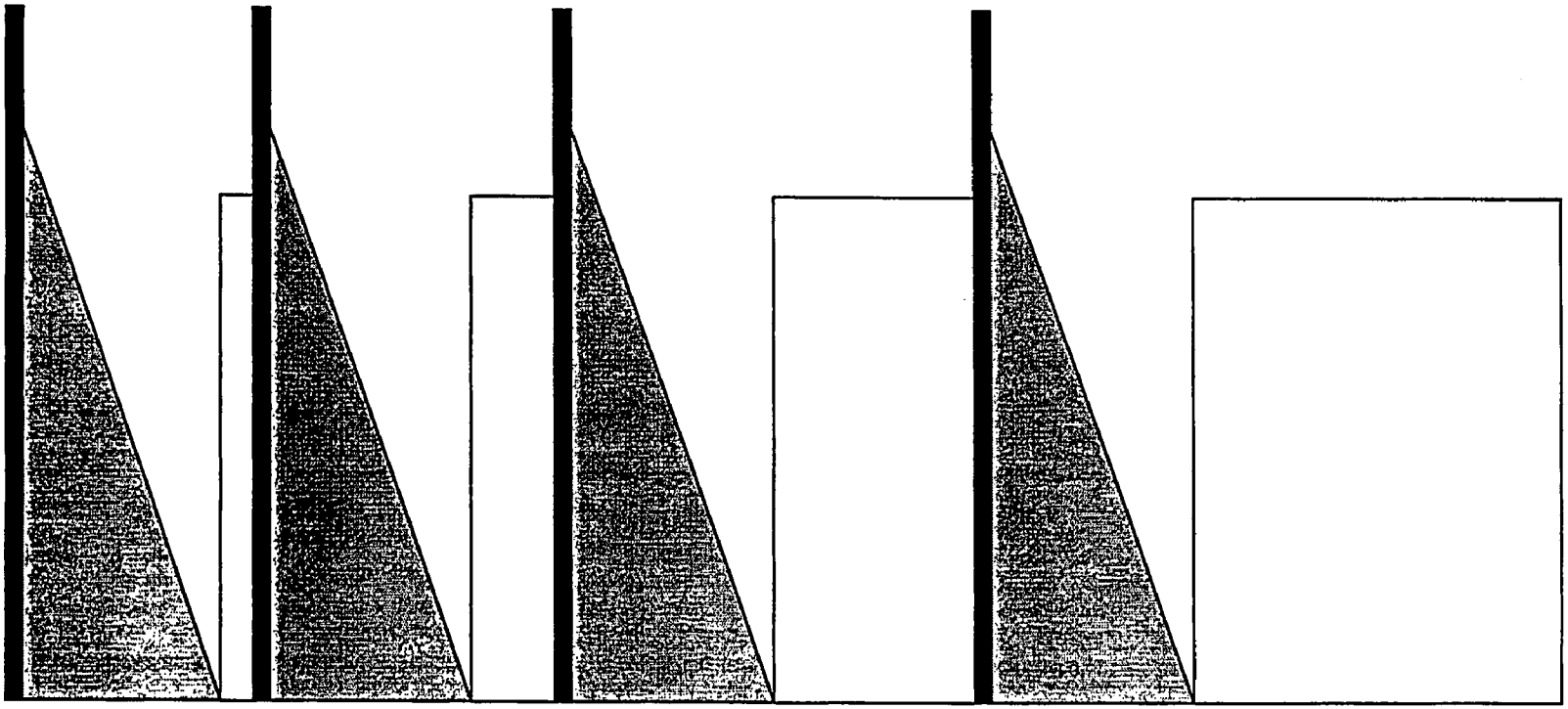
FIG. 5 illustrates addressing erasing and sustaining periods of a single frame time.

FIG. 5 schematically shows different periods during a frame time. Plasma Display Panels consist of cells in three primary colors; red green and blue. These cells are either on or off. To display multiple gray levels, the principle of pulse-width modulation is used. The total frame time is divided into a number of so-called subfields. These subfields are of different duration. In each subfield a cell is either on or off. Different gray levels can be formed by selecting an appropriate combination of subfields to emit light All cells in the entire screen behave in the same way; per subfield it is decided for each cell whether it should emit light. These cells are now addressed on a line-at-a-time basis, on the vertical address electrodes, the information is set for the first line. Then a pulse is applied to the horizontal electrodes to actually address the first line. Subsequently, the information on the address electrodes is changed to depict the second line, etc. Because of this principle, the addressing of an entire panel takes quite some time.

FIG. 5 shows all parts of a single frame time; the black rectangles stand for the erasing periods, the gray triangles for the addressing periods and the white rectangles for the sustaining periods. Addressing takes quite some time, that is, usually some 60-70% of the total frame time. Light is emitted only in the sustain phases. It can also be seen that a reduced addressing time leaves more time available for sustaining, i.e. light emission. The present invention allows for such a reduction of the addressing time since each cell has a neighboring cell of the same color on the same addressing electrode in a neighboring row.

FIGS. 6A to 6G show different realizations of the transparent parts 11 of the electrodes in a plasma display panel according to the invention. In the realization of FIG. 6A, the transparent parts 11 extend partly over the cell immediately above or below. The light-producing area is thereby enlarged, and the brightness is improved.

FIGS. 6B to 6E show embodiments where the address electrodes 5 extend over only part of the width of a cell. In FIG. 6C, the narrow address electrodes 5 have a wider part near the gap 13. All embodiments shown in the FIGS. 6D to 6G allow an increase of the length of the gap 13. The surface gas discharge between the scan electrodes 8 and the common electrodes 7 is thereby improved.

Figures 7A, 7B, 7C:
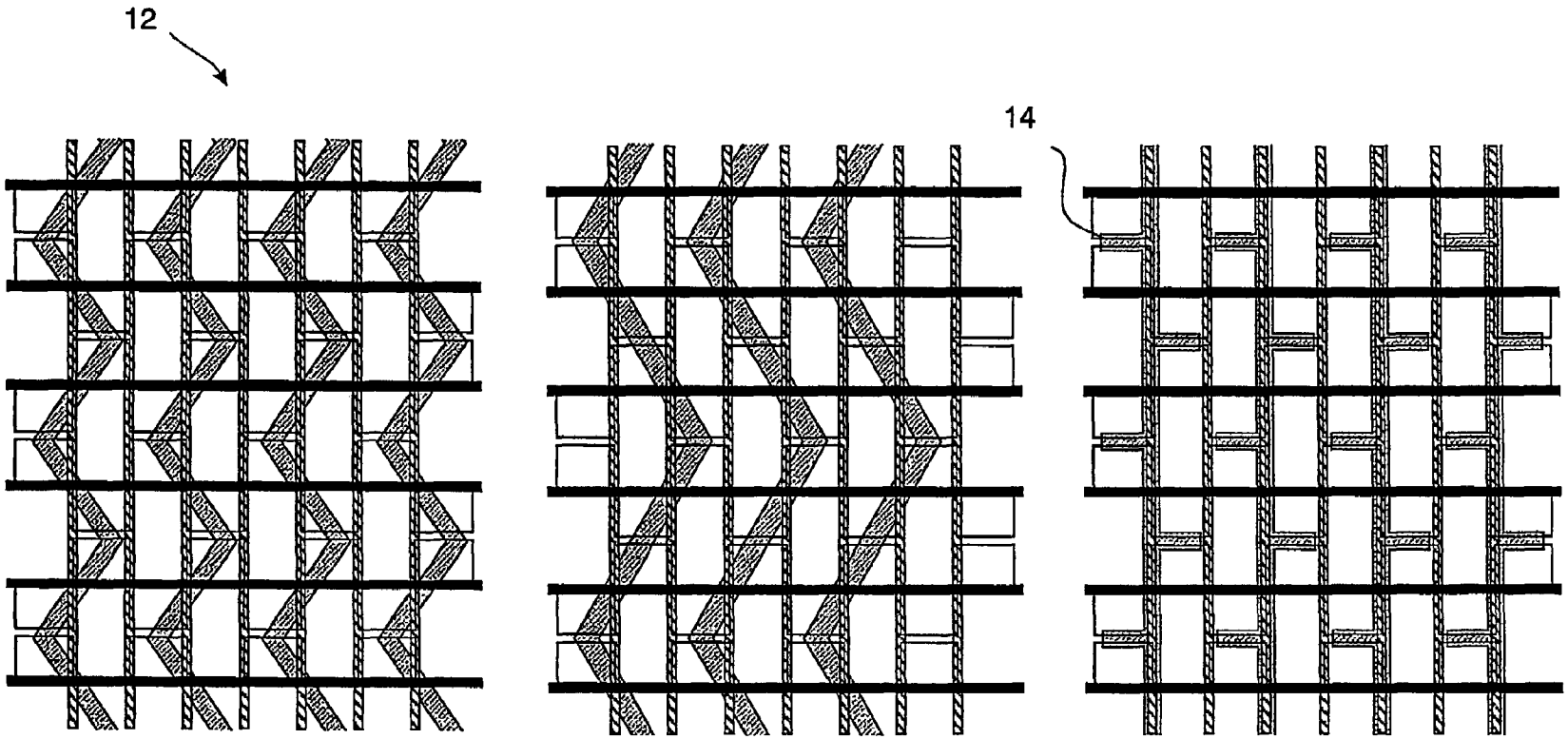
FIGS. 7A and 7B are front views of plasma display panels according to the invention in which the address electrodes are of the zigzag type.
FIG. 7C is a front view of a plasma display panel according to the invention in which the address electrodes have extensions.

FIGS. 7A and 7B show embodiments wherein the address electrodes 5 have a zigzag shape. In FIG. 7A, the vertical periodicity of the zigzag is two rows, whereas in FIG. 7B it is four rows. Other realizations are also possible, including the case where the address electrodes 5 are straight lines extending diagonally from the top to the bottom of the panel, provided that one out of every two cells of the panel is traversed by an address electrode 5 in a checkerboard fashion.

In FIG. 7C, the address electrodes 5 comprise extensions 14. These extensions 14 partly cover one out of every two cells with transparent parts 11, and preferably also the gap 13 area between the two transparent parts 11. The principal part of the address electrodes 5 may then be narrower and even be completely covered by the barrier ribs 6.

Figure 8:
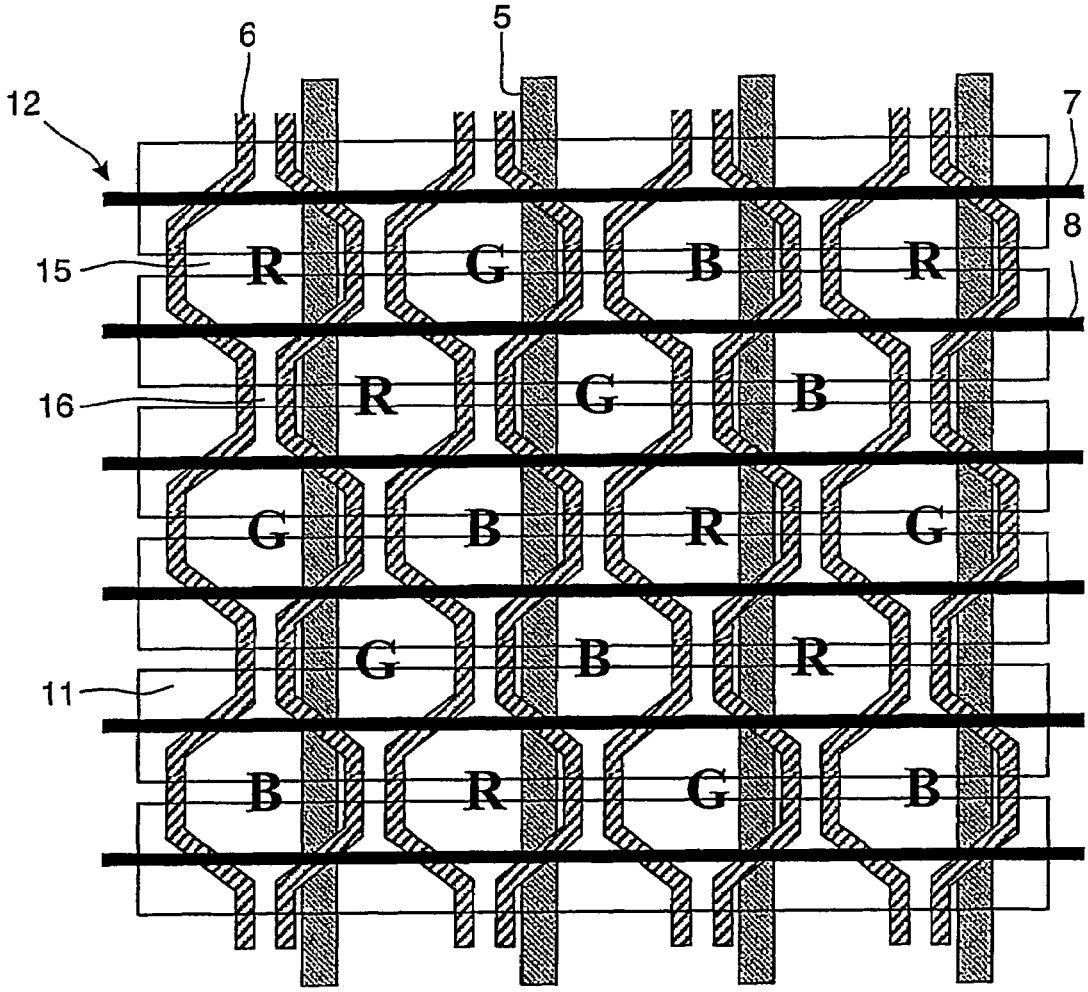
FIG. 8 is a front view of a plasma display panel according to a preferred embodiment of the invention.

FIG. 8 shows a preferred embodiment of the invention. The barrier ribs 6 are formed in such a shape that the columns have widths varying between a first width and a second width. Odd columns have the larger width 15 over odd rows, and the smaller width 16 over even rows, and even columns have the larger width over even rows and the smaller width over odd rows. The panel 12 thus has the overall structure of a honeycomb. The address electrodes 5 are in this exemplary embodiment straight vertical strips. The larger column width, the smaller column width and the width of the address electrodes 5 are such that only the cells where light production is desired are partly covered by the address electrodes 5. The narrower cells are not covered by an address electrode 5. The transparent parts 11 may then extend also over cells where no light production is desired and be formed as simple straight strips along the length of the scan electrodes and the common electrodes. This embodiment has the advantage of a much higher brightness. The common electrodes and scan electrodes may also be formed by a set of horizontal thin lines linked by vertical lines, thereby forming strips of a metallic thin grid.

When applying the invention to a RGB display, a pixel, i.e. the combination of a red cell, a green cell, and a blue cell, has the shape of a triangle in the examples shown. As can be seen in FIGS. 3A and 3B, when considering a pair of rows, one finds a first RGB triangle having its top facing down, followed by an adjacent triangle having its top facing up. This gives the a so-called delta-nabla structure. FIG. 3B explicitly shows two such triangles.

While the invention has been described with reference to preferred embodiments, it will be understood that modifications thereof within the scope of the principles outlined above will be evident to those skilled in the art; therefore, the invention is not limited to the preferred embodiments but is intended to encompass such modifications. The horizontal and vertical directions may be interchanged. Although the invention has been described with reference to a color display using three colors (red, green blue), the invention may be applied to displays using other color combinations. The invention is embodied in each new characteristic and each combination of characteristics. Any reference signs do not limit the scope of the claims. The word "comprising" does not exclude the presence of other elements than those listed in a claim. Use of the word "a" or "an" preceding an element does not exclude the presence of a plurality of such elements. The mere fact that certain measures are recited in mutually different dependent claims does not indicate that a combination of these measures cannot be used to good advantage.

Figure 9:
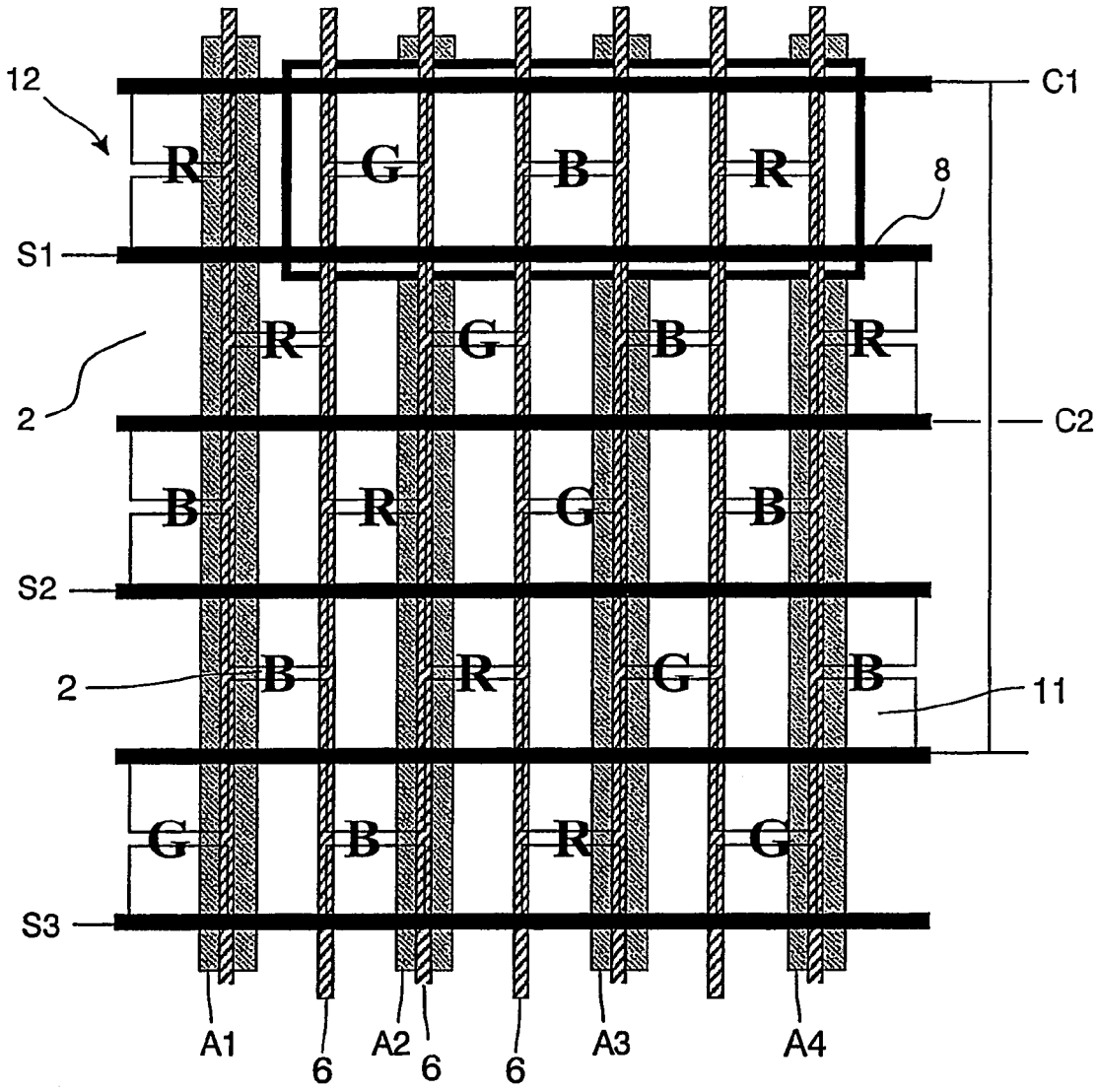
FIG. 9 illustrates a further embodiment of the invention.

For the sake of clarity, the drawings show a limited number of rows and columns. The invention, however, applies to plasma display panels having larger numbers of rows and columns. The 'column direction' is herein for the sake of clarity described as the 'vertical direction' and the 'row or line direction' as the horizontal direction. The examples shown in previous figures have delta-nabla structures; the invention is, however, not restricted to such structures only. FIG. 9 shows and example in which the phosphor elements are arranged such that phosphor elements of one color are arranged in parallel diagonal lines; in this example the pixels form rectangles, one of which is schematically shown in FIG. 9.

Figure 10:
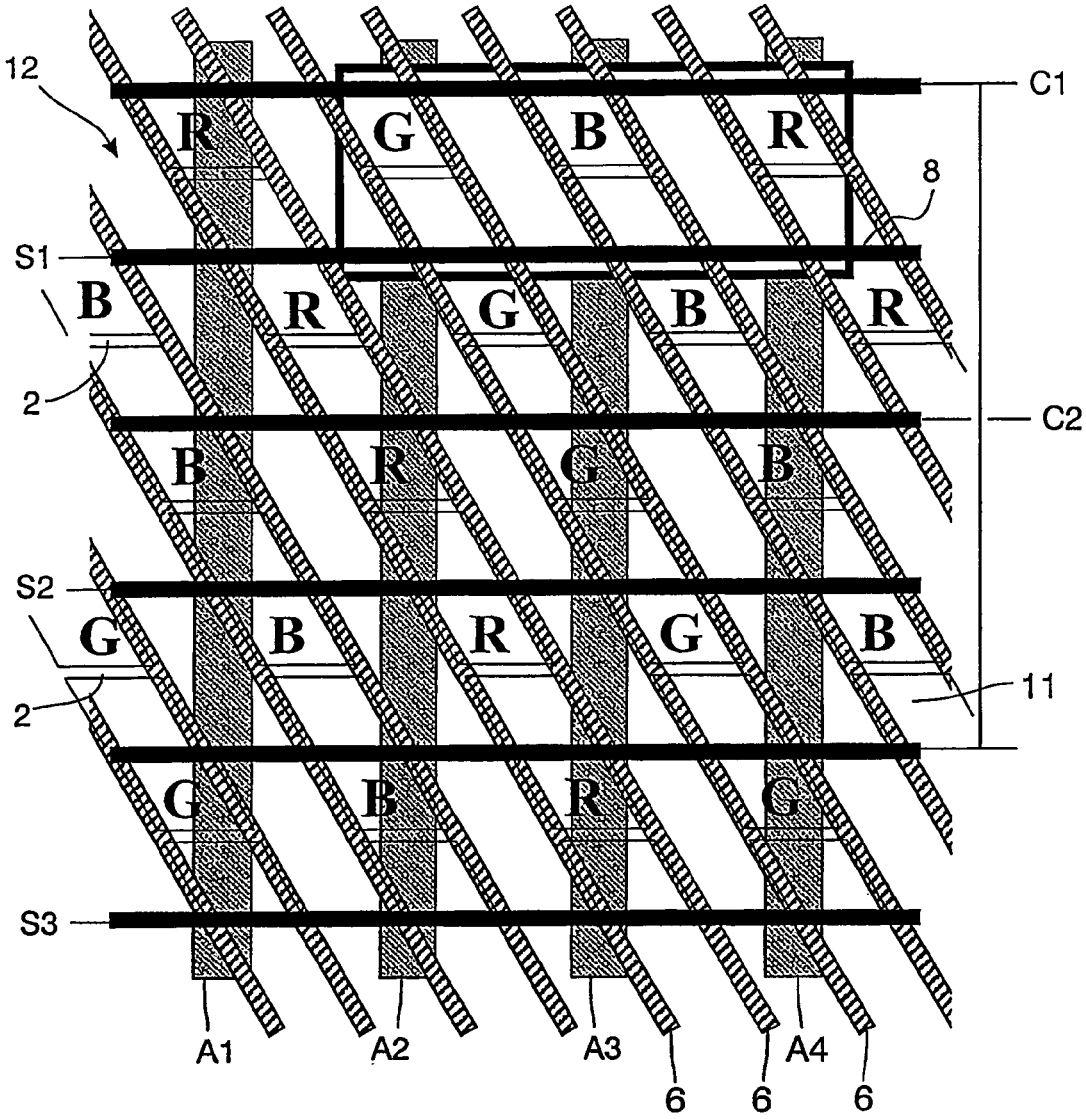
FIG. 10 illustrates an embodiment of the invention having barrier ribs positioned under an angle.

The barrier ribs 6 in FIG. 9 are positioned under an angle of substantially $90^0$ with respect to the first direction. The barrier ribs 6 may also be positioned under an angle different from 90° with respect to the first direction, as shown in FIG. 10. The advantage compared to the embodiment shown in FIG. 9 is that in a column between two barrier ribs 6 phosphor of only one color is present, which is easier to manufacture. The different colors are indicated with the letters R, G, B.

Figure 11:
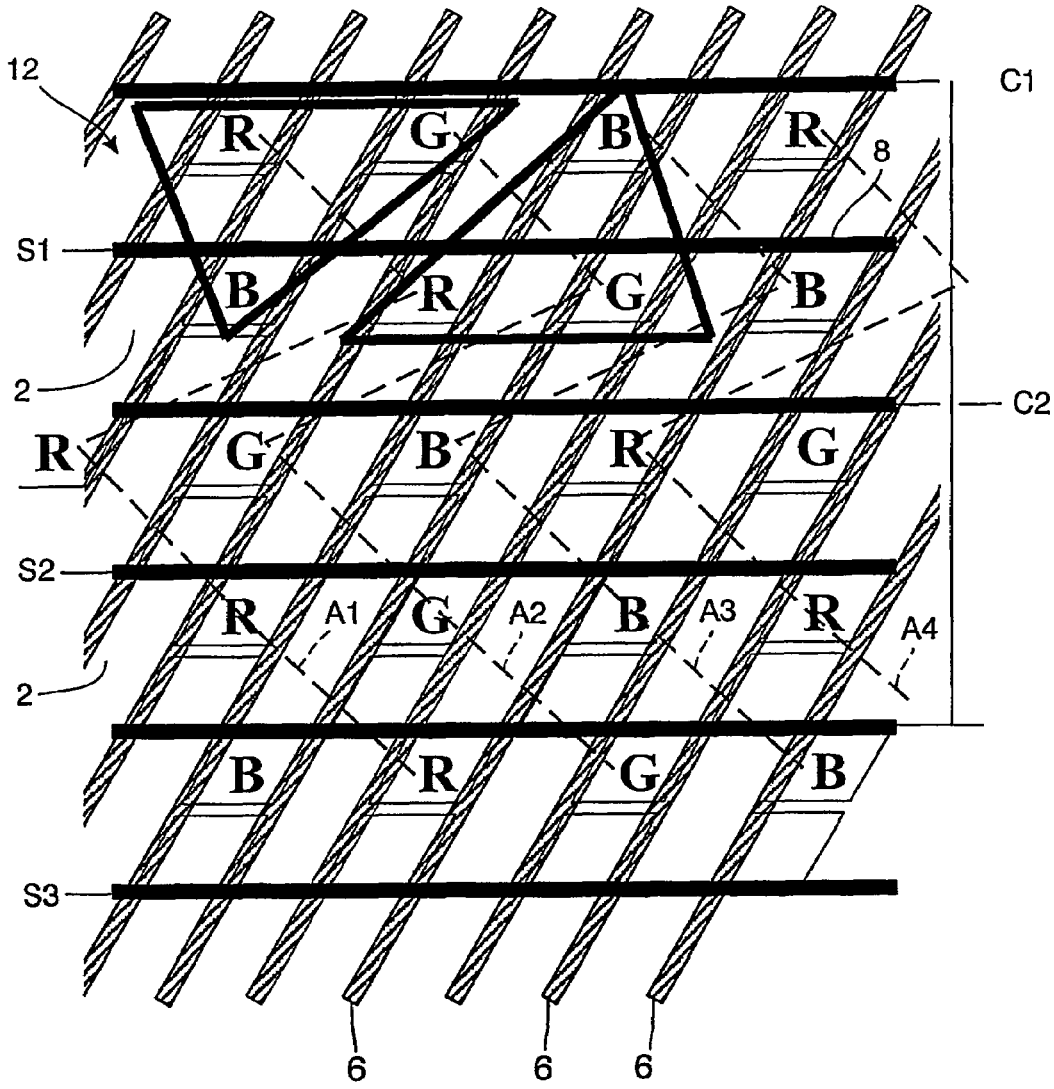
FIG. 11 illustrates another embodiment of the invention having barrier ribs positioned under an angle.

FIG. 11 shows another embodiment of the invention, having barrier ribs 6 positioned under an angle. Again, between two barrier ribs 6 phosphor of only one color is present. However, compared to FIG. 10 the address electrodes A1 . . . A4 extend via a zigzag shape in a direction substantially perpendicular to the common electrodes C1, C2. This embodiment provides again a delta-nabla pixel structure as indicated with two triangles in FIG. 11.

Figure 12:
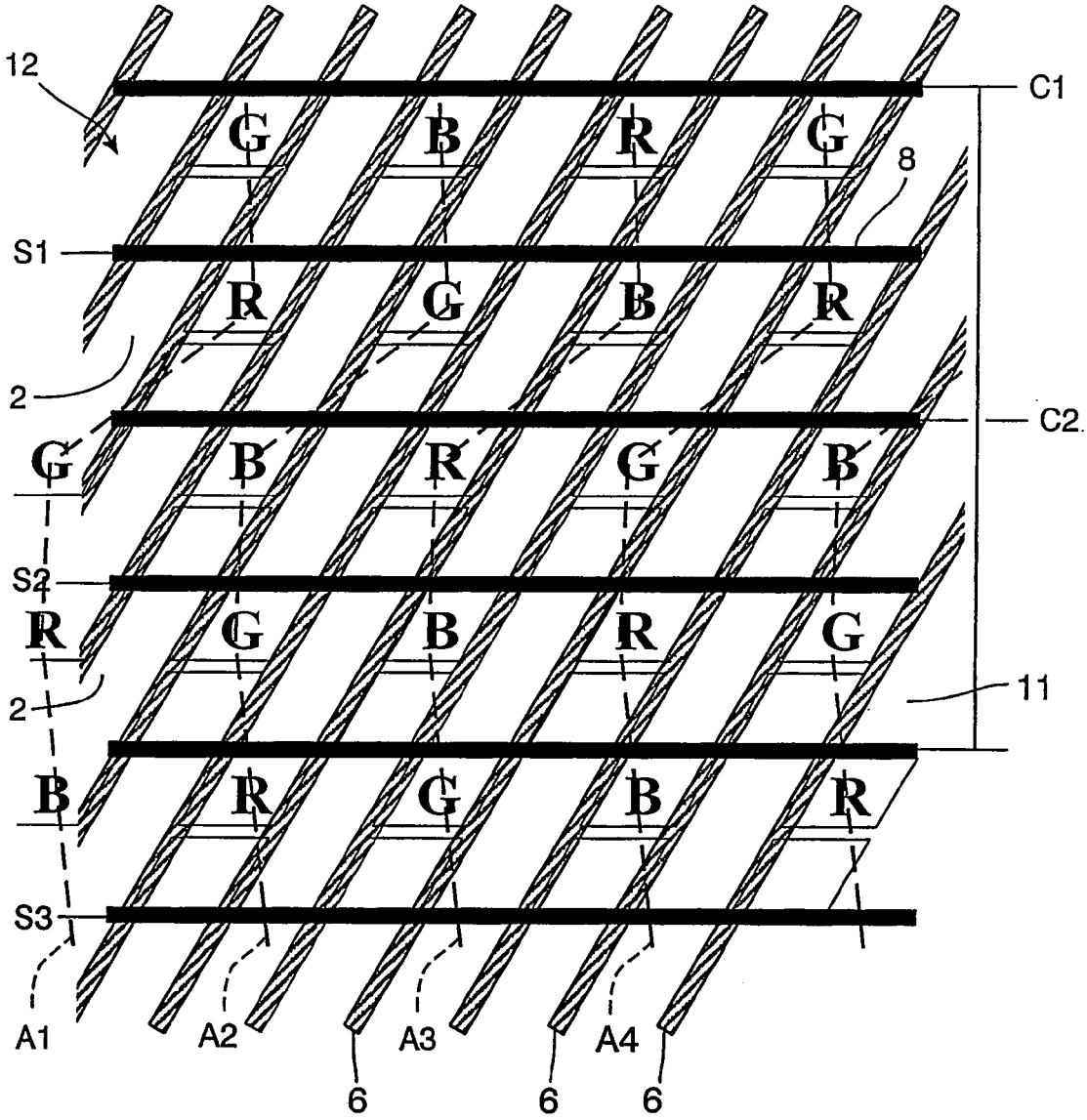
FIG. 12 illustrates yet another embodiment of the invention having barrier ribs positioned under an angle.

Yet another embodiment with barrier ribs 6 positioned under an angle, is shown in FIG. 12. Each of the address electrodes A1 . . . A4 extends over two cells of a same color in two successive odd rows as well as over two cell of a same color (which color may be different from the color of the two cells in the odd rows) in two successive odd rows. This address electrode structure is easy to manufacture. PLD may be applied by simultaneously addressing pairs of successive even rows or pairs of successive odd rows.

Figure 13:
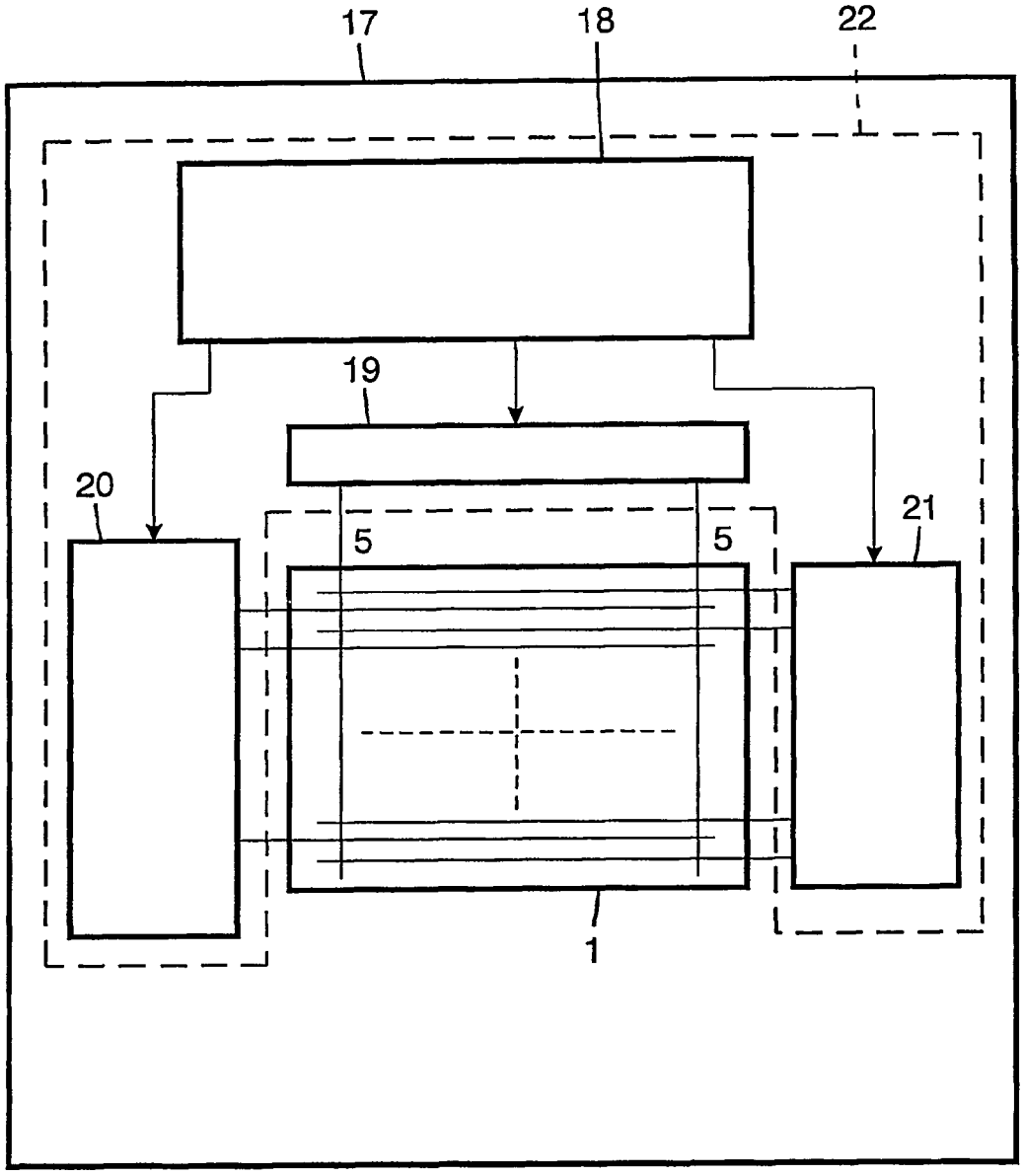
FIG. 13 illustrates schematically a plasma display panel device in accordance with the invention.

Finally FIG. 13 illustrates schematically a plasma panel display device in accordance with the invention. The plasma panel display device 17 comprises a plasma display panel 1 and a driving circuit (22), in this example comprising an address driver (19), a y-driver (20), an X-driver (21) and a control circuit (18) coupled to the drivers. The driving circuit 22 is-arranged such that Partial Line Doubling (PLD) or line doubling or Bit Line Repeat (BLR),is performed, i.e. in or for at least one of the sub-fields, said neighboring cells (R1, R2; G1,G2; B1,B2) being addressed simultaneously.

'Plasma display panel device' encompasses within the framework of the invention any device having the mentioned elements, whether it is a TV set having a plasma display panel and driving circuits separate from the display panel, or a module comprised of a display panel to which a driving circuit is attached or physically coupled or integrated or any other type of device.

The invention can be summarized as follows.

The invention relates to an AC plasma display panel (12) of the surface discharge type, and more specifically to the structure of the address electrodes (5) of said panel and of the phosphor elements, and to a display panel device comprising such a panel. According to the invention, only one address electrode (5) is used for one out of every two columns. Scan electrodes (8) and common (7) electrodes may comprise transparent parts (11). These parts (11) may extend over one out every two cells in a checkerboard fashion. In a preferred embodiment as shown in FIG. 7, the columns may have alternating wide (15) and narrow (16) cells (2). Furthermore, each cell has a neighbor-cell of the same color, on the same address electrode but in an adjacent column and in an adjacent row. The display panel device comprises a driving circuit (22) for addressing the cells arranged such that in at least some of the sub-fields said neighboring cells are addressed simultaneously.

List of References in Figures

1. Plasma display-panel known in the prior art
2. Cell
3. Front plate
4. Back plate
5. Address electrode
6. Barrier rib
7. Common (X) electrode
8. Scan (Y) electrode
9. Phosphor

10. Conductive, preferably metallic part
11. Transparent part
12. Plasma display panel according to the invention
13. Gap
14. Extension
15. Cell of larger width
16. Cell of reduced width
17. Plasma panel display device
18. Control circuit
19. Address driver
20. Y driver
21. X-driver
22. Driving circuit

The invention claimed is:

1. A plasma display panel comprising a first substrate on which is formed a set of common electrodes extending in a first direction, and, alternately with said common electrodes, a set of scan electrodes extending in the same direction, the space delimited between a common electrode and a scan electrode defining a row, and a second substrate parallel to said first substrate having, on which is formed a set of address electrodes and a set of barrier ribs, both extending substantially under an angle to said first direction, the space delimited by a pair of adjacent barrier ribs defining a column, the space at the intersection of a row and a column defining a cell, wherein an address electrode extends over more than one column, covering at least a part of a first cell in a first column in one row, and at least a part of a second cell in a second column in the row immediately below, no other address electrode extending over the cell immediately below the first cell, no other address electrode extending over the cell immediately above the second cell, and in that each cell has a neighbor-cell of the same color, on the same address electrode but in a neighboring column and in a neighboring row.

2. The plasma display panel of claim 1, wherein the angle is substantially 90°, the neighboring column is an adjacent column, and the neighboring row is an adjacent row.

3. The plasma display panel as of claim 2, wherein the common electrodes and the scan electrodes comprise a conductive part and a set of transparent parts, each transparent part extending on one side of the corresponding conductive part, a transparent part of a common electrode and a transparent part of an adjacent scan electrode extending towards each other over one every two cells in a checkerboard fashion, a gap remaining between said two transparent parts, and said one of every two cells being covered by an address electrode.

4. The plasma display panel as of claim 3, wherein at least some of the transparent parts are made of a metallic grid.

5. The plasma display panel as of claim 3, wherein the address electrodes are straight strips, formed underneath a barrier rib separating two adjacent columns.

6. The plasma display pane as of claim 1, wherein the address electrodes are formed in a zigzag shape.

7. The plasma display panel as of claim 3, wherein the transparent parts extend over the other side of said conductive part.

8. The plasma display panel as of claim 3, wherein the transparent parts extend over only part of the width of a cell.

9. The plasma display panel as of claim 8, wherein the transparent parts have a wider portion near said gap.

10. The plasma display panel as of claim 8, wherein said two transparent parts extend side by side, the gap between said two transparent parts extending perpendicularly to the first direction over said cell.

11. The plasma display panel as of claim 3, wherein the address electrodes comprise an extension extending substantially over the gap.

12. The plasma display panel as of claim 1, wherein said barrier ribs have a zigzag configuration, such that the width of a column varies between a first width and a second width, a first column having the larger width over even rows and the smaller width over odd rows, a column adjacent to said first column having the larger of said first and second widths extending over odd rows and the smaller of said first and second widths extending over even rows.

13. The plasma display panel as of claim 3, wherein said transparent parts are strips extending along the length of corresponding conductive parts.

14. The plasma display panel as of claim 1, wherein cells in a column are the same color.

15. The plasma display panel as of claim 1, wherein cells over which an address electrode extends are of the same color.

16. A plasma display panel device, comprising the plasma display panel of claim 1, wherein the plasma panel display device comprises a driving circuit for addressing the cells in sub-fields which is arranged such that in at least one of the sub-fields said neighboring cells are addressed simultaneously.

* * * * *